US009487904B2

(12) United States Patent
Kim et al.

(10) Patent No.: US 9,487,904 B2
(45) Date of Patent: Nov. 8, 2016

(54) DETERGENT DISSOLUTION DEVICE FOR LAUNDRY TREATING APPARATUS

(71) Applicant: LG ELECTRONICS INC., Seoul (KR)

(72) Inventors: Naeun Kim, Seoul (KR); Dongwon Kim, Seoul (KR); Mingyu Jo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 136 days.

(21) Appl. No.: 14/039,442

(22) Filed: Sep. 27, 2013

(65) Prior Publication Data

US 2014/0096572 A1 Apr. 10, 2014

(30) Foreign Application Priority Data

Oct. 10, 2012 (KR) ..... 10-2012-0112318

(51) Int. Cl.

| | |
|---|---|
| ***D06F 39/08*** | (2006.01) |
| ***D06F 39/12*** | (2006.01) |
| ***D06F 31/00*** | (2006.01) |
| ***D06F 39/02*** | (2006.01) |

(52) U.S. Cl.

CPC ..... *D06F 39/028* (2013.01); *D06F 31/00* (2013.01); *D06F 39/02* (2013.01); *D06F 39/083* (2013.01); *D06F 39/088* (2013.01); *D06F 39/12* (2013.01)

(58) Field of Classification Search

CPC .... D06F 39/028; D06F 39/088; D06F 39/12; D06F 39/02; D06F 39/083

USPC ..... 68/17 R; 137/624.18, 625, 625.46, 137/625.11, 597

See application file for complete search history.

(56) References Cited

U.S. PATENT DOCUMENTS

| | | | | |
|---|---|---|---|---|
| 3,779,269 | A * | 12/1973 | Gould | 137/119.07 |
| 2011/0119838 | A1* | 5/2011 | Yang | D06F 5/006 8/137 |
| 2011/0154865 | A1 | 6/2011 | Lee et al. | |
| 2011/0174021 | A1* | 7/2011 | Lee et al. | 68/17 R |
| 2012/0103028 | A1 | 5/2012 | Lee et al. | |

FOREIGN PATENT DOCUMENTS

| | | | |
|---|---|---|---|
| CN | 1637191 | A | 7/2005 |
| CN | 102205285 | A | 10/2011 |
| EP | 2 011 913 | A1 | 1/2009 |
| JP | 07-068082 | | 3/1995 |

OTHER PUBLICATIONS

Machine Translation of JP 07-68082.*

European Search Report issued in Appln 13187941.3—1710 issued on Feb. 17, 2014.

Chinese Office Action dated Jul. 3, 2015 issued in Application No. 201310471345.0 (Original Office Action and English Translation).

* cited by examiner

*Primary Examiner* — Michael Barr
*Assistant Examiner* — Rita Adhlakha
(74) *Attorney, Agent, or Firm* — Ked & Associates LLP

(57) ABSTRACT

A laundry treating apparatus is provided. The laundry treating apparatus may include a detergent storage device positioned below an introduction port for introducing laundry into and removing laundry from a washing tub of the apparatus, a detergent dissolution device to dissolve detergent in water, and a flow path switching valve to selectively open a flow path for dissolution of the detergent and a flow path for supply of the dissolved detergent and washing water solution to the washing tub.

17 Claims, 7 Drawing Sheets

DETERGENT DISSOLUTION DEVICE FOR LAUNDRY TREATING APPARATUS

CROSS-REFERENCE TO RELATED APPLICATION(S)

This application claims priority under 35 U.S.C. §119 to Korean Application No. 10-2012-0112318, filed on Oct. 10, 2012, whose entire disclosure is hereby incorporated by reference.

BACKGROUND

1. Field

This relates to a laundry treating apparatus.

2. Background

A washing machine may remove contaminants from laundry by utilizing softening action provided by detergent, frictional action provided by wash water flow generated due to rotational action, impact of the wash water flow applied to the laundry, and other such factors. A laundry treating apparatus may be capable of washing and/or drying the laundry, or using a steam supply device to perform a refreshing function that removes odors, wrinkles and static electricity.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings. The apparatus and method described below are simply illustrative and are not intended to limit the scope as broadly described herein. Wherever possible, the same reference numbers will be used throughout the drawings to refer to the same or like parts.

A laundry treating apparatus may include a cabinet having a laundry introduction port, a tub provided in the cabinet to contain wash water, a drum rotatably provided in the tub, a water supply device to supply wash water to the tub, and a detergent supply device to supply detergent and/other washing agents to the tub along with the wash water supplied by the water supply device. Such a detergent supply device may be located above the laundry introduction port. It may become difficult to supply detergent into the detergent supply device as a size of the laundry treating apparatus increases.

Additionally, powdered detergent is not necessarily fully and/or easily dissolved in wash water prior to being supplied to the tub, but rather, may, in some circumstances be supplied to the tub with the wash water and then dissolved in the wash water in the tub. That is, there may be a delay for the detergent to completely dissolve in the wash water in the tub. Moreover, if the detergent fails to completely dissolve in the wash water, it may remain on the laundry, thus increasing washing time and degrading washing performance.

A laundry treating apparatus 100 as embodied and broadly described herein may include a first treating apparatus T to treat (wash and/or dry) laundry, or may include the first treating apparatus T and a second treating apparatus L arranged, for example, below the first treating apparatus T, to treat (wash and/or dry) laundry. In the exemplary embodiment described hereinafter, the laundry treating apparatus 100 may include both the first treating apparatus T and the second treating apparatus L.

Figure 1:
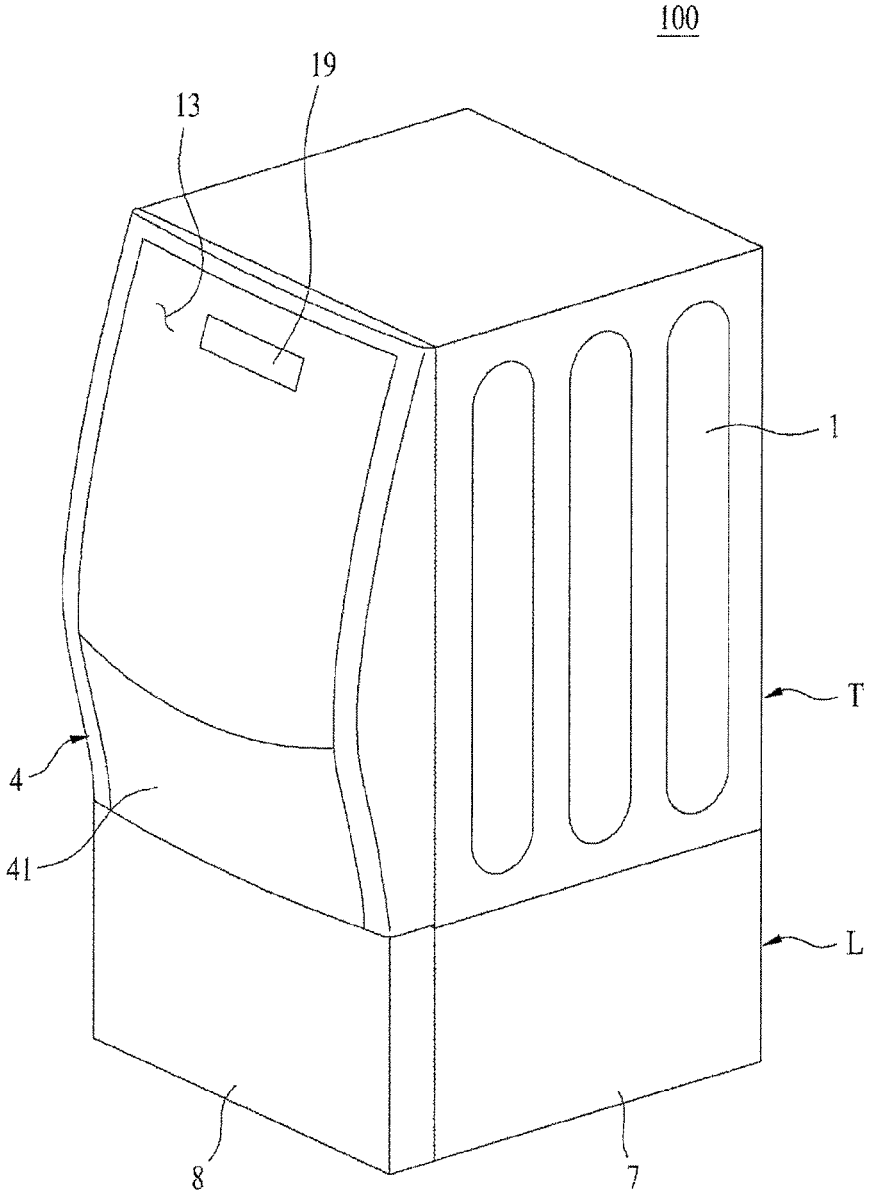
FIGS. 1 and 2 are perspective views of a laundry treating apparatus in accordance with embodiments as broadly described herein.
Figure 2:
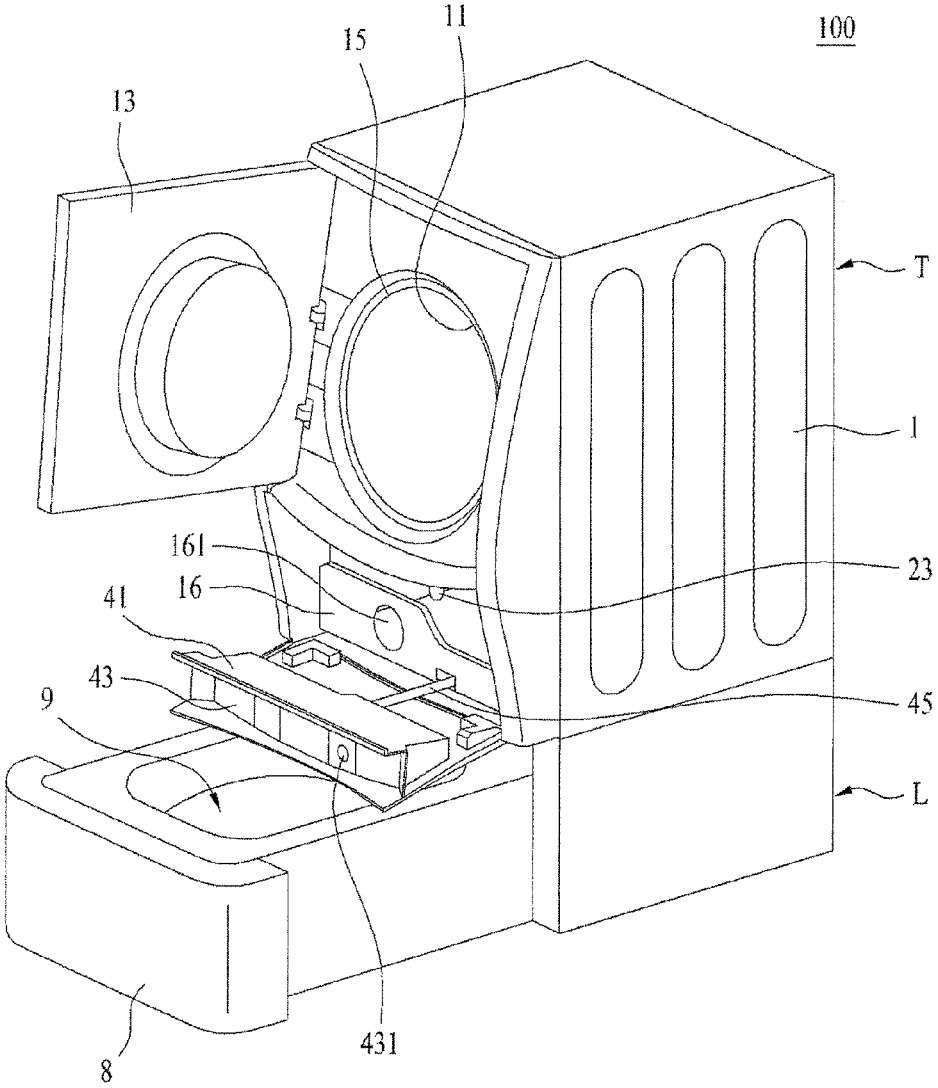

As shown in FIGS. 1 and 2, the first treating apparatus T may include a cabinet 1 forming an external appearance of the first treating apparatus T, a tub 15 provided in the cabinet 1 to contain wash water, and a drum 17 (see FIG. 3B) rotatably provided in the tub 15 to receive laundry therein. The cabinet 1 may include an introduction port, or cabinet opening, 11 through which the laundry is introduced into or retrieved from the drum 17. The introduction port 11 may be opened and closed by a door 13 rotatably coupled to the cabinet 1.

Figure 3B:
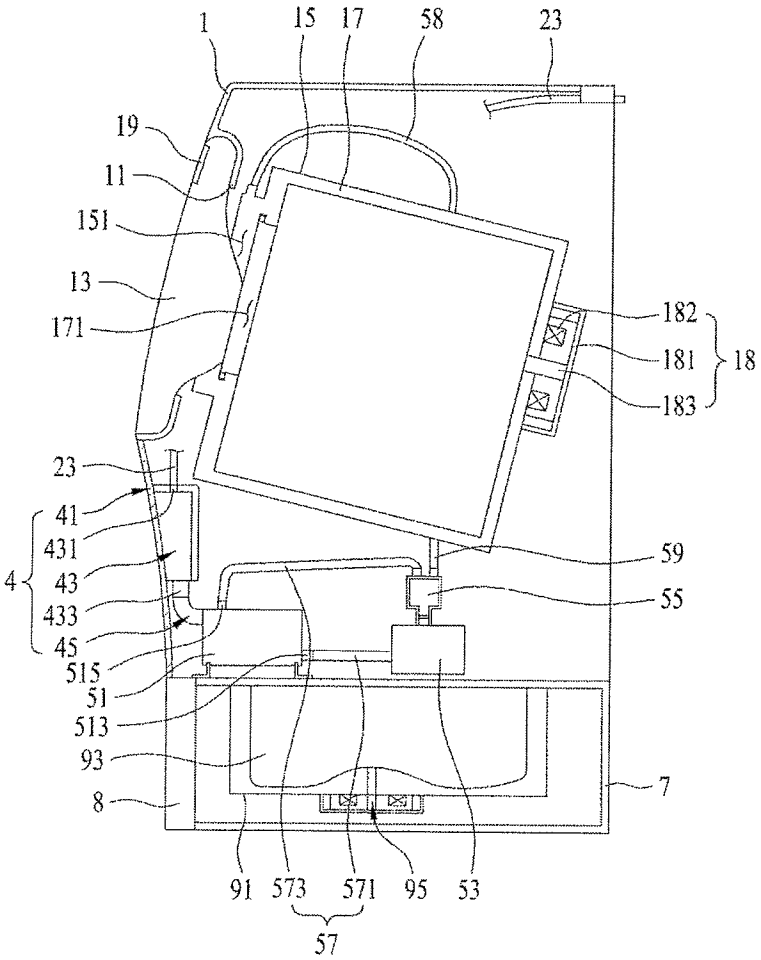
FIGS. 3A-3B and 4A-4B are various views of an internal structure of the laundry treating apparatus shown in FIGS. 1 and 2.

As shown in FIG. 3B, the tub 15 may include a tub opening 151 corresponding to the introduction port 11, and the drum 17 may include a drum opening 171 corresponding to the introduction port 11 and the tub opening 151, so that the user may introduce laundry into or retrieve laundry from the drum 17 through the tub openings 151 and 171 when the introduction port 11 is opened by opening the door 13.

In certain embodiments, the tub 15 and the drum 17 may be inclined at a predetermined angle within the cabinet 1. To this end, the front surface of the cabinet 1 may be formed by an inclined surface, and the introduction port 11 may be provided on the inclined surface. The tub 15 and drum 17 may be inclined such that the tub opening 151 and the drum opening 171 form plane(s) parallel with the introduction port 11. That is, the inclination angle of the tub 15 and drum 17 with respect to an installation surface, such as the floor or the the ground (or a horizontal line), may be equal to the inclination angle of the front surface (inclined surface) of the cabinet 1.

In certain embodiments, the door 13 may be hinge-coupled to the inclined surface to open and close the introduction port 11, the tub opening 151, and the drum opening 171.

A driver 18 may be provided in the cabinet 1 to rotate the drum 17. The driver 18 may include a stator 182 fixed to the rear surface of the tub 15, a rotor 181 surrounding the stator 182, and a rotating shaft 183 having one end fixed to the rotor and the other end fixed the rear surface of the drum 17 through the tub 15.

The first treating apparatus T may include a water supply device 2 to supply wash water to the tub, and a drainage device 3 to discharge the wash water from the tub 15.

The drainage device 3 may include a drainage flow path 31 arranged below the tub 15, and a drainage pump 33 to discharge the wash water from the drainage flow path 31. The drainage flow path 31 may include a first drainage flow path 311 to connect the tub 15 with the drainage pump 33, and a second drainage flow path 313 to connect the drainage pump 33 to the outside of the cabinet 1.

The drainage device 3 may also include a filter 35 to remove foreign substances from the wash water discharged from the tub 15. In certain embodiments, the filter 35 may be arranged in the first drainage flow path 311 such that the wash water flowing in the first drainage flow path 311 moves to the drainage pump 33 via the filter 35 (see FIG. 7B).

In certain embodiments, the filter 35 may be removable from the first drainage flow path 311 to allow for cleaning of the filter 35. In this case, the filter 35 may be removed from the first drainage flow path 311 through a filter attachment hole 161 (see FIG. 2) provided in a frame 16 (positioned below the introduction port 11 to maintain a predetermined gap), which is exposed when a storage unit door 41 is opened.

The water supply device 2 may include a water supply valve 21 connected to a water source and a water supply flow path 23 to be opened and closed by the water supply valve 21. The wash water may be supplied to the tub 15 through the water supply flow path 23.

Figure 3A:
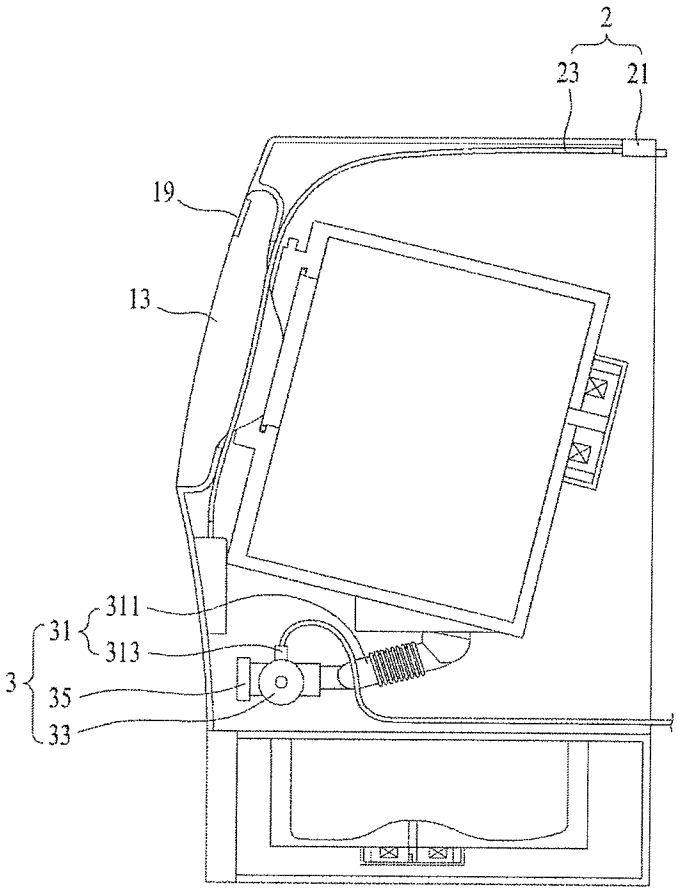

In this embodiment, the water supply flow path 23 shown in FIG. 3A is arranged to supply wash water to a detergent storage device 4. Alternatively, the water supply flow path 23 may be arranged to connect the water supply valve 21 with the tub 15.

In the case in which the water supply flow path 23 connects the water supply valve 21 to the tub 15, a separate flow path branched from the water supply flow path 23 may be provided to supply wash water to the detergent storage device 4.

Figure 4A:
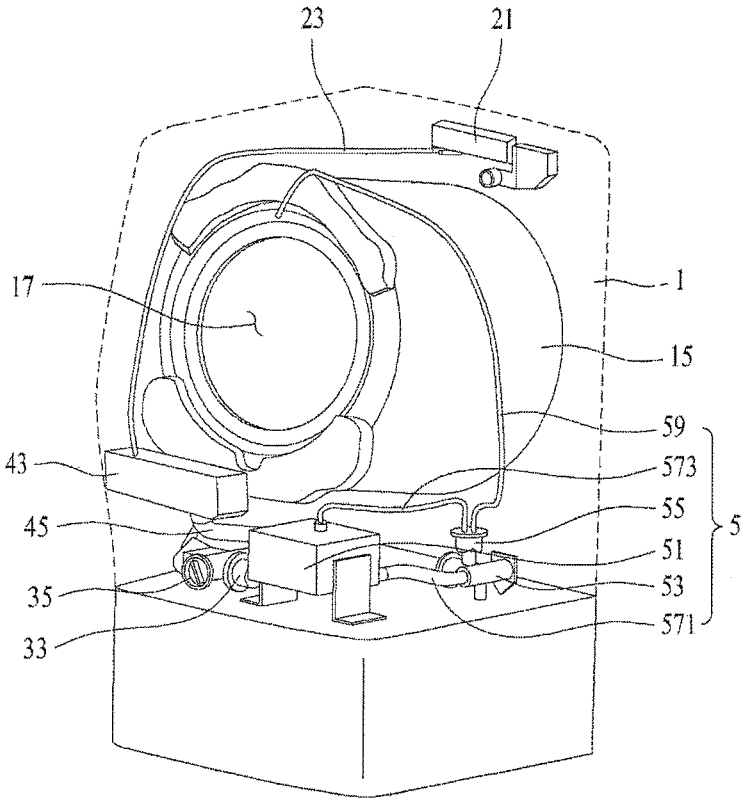

In the case in which the water supply flow path 23 is arranged to supply wash water to the detergent storage device 4, the wash water discharged from the detergent storage device 4 may be supplied to the tub 15 through a pump 53 and tub supply flow path 59 provided with a detergent dissolution device 5 (see FIG. 4A).

A control panel 19 may be provided at the door 13 to display an input control command or a control process of the laundry treating apparatus. For example, the control panel 19 may be arranged on the front surface of the door 13.

The first treating apparatus T may include the detergent storage device 4 to store detergent and other wash agents to be supplied to the tub 15, and the detergent dissolution device 5 to dissolve the detergent discharged along with the wash water from the detergent storage device 4 in the wash water before supply to the tub 15.

The detergent storage device 4 may include, as shown in FIG. 2, the storage unit door 41, a detergent box 43 provided at the storage unit door 41, and a detergent discharge flow path 45 to guide the detergent stored in the detergent box 43 to the detergent dissolution device 5.

The storage unit door 41 may be rotatably arranged below the introduction port 11 provided in the cabinet 1. The detergent box 43 is detachably provided at the storage unit door 41.

The storage unit door 41 may be coupled to the cabinet 1 in various ways. For example, the lower portion of the storage unit door 41 may be fixed to the frame 16 by a hinge. In this case, the storage unit door 41 may further include a door fixing device to fix the storage unit door 41 to the cabinet 1.

In a case in which the detergent box 43 is detachably provided at the storage unit door 41, the detergent box 43 may include a flow inlet 431 detachable from the water supply flow path 23. Accordingly, to introduce detergent into the detergent box 43, the user may expose the detergent box 43 to the outside of the cabinet 1 by rotating the storage unit door 41 and then supply the detergent to the detergent box 43 through the flow inlet 431 that has been removed, or detached, from the water supply flow path 23.

In addition, a flow outlet 433 (see FIG. 3B) of the detergent box 43 may be removable from the detergent discharge flow path 45, and thus the user may retrieve the detergent box 43 from the storage unit door 41 and clean inside of the detergent box 43 and the storage unit door 41.

As shown in FIG. 4A, the detergent dissolution device 5 may include a dissolution box 51, a pump 53 and a dissolution flow path 57. The dissolution box 51 may be connected to the detergent box 43 by the detergent discharge flow path 45. For example, the dissolution box 51 may be positioned below the detergent box 43 such that the detergent and wash water may be naturally introduced into the dissolution box 51 by gravity when the wash water is supplied to the detergent box 43.

Figure 4B:
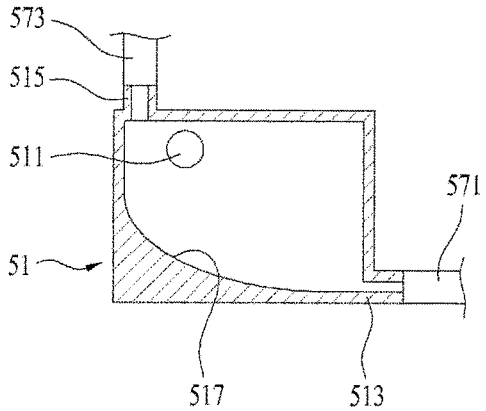

The dissolution flow path 57 may include a first dissolution flow path 571 to guide wash fluid from the dissolution box 51 to the pump 53, and a second dissolution flow path 573 to guide the detergent and wash water from the pump 53 to the dissolution box 51. In this case, the dissolution box 51, as shown in FIG. 4B, may include a discharge flow path connection hole 511 to which the detergent discharge flow path 45 is connected, a first flow path connector 513 to which the first dissolution flow path 571 is connected, and a second flow path connector 515 to which the second dissolution flow path 573 is connected.

The first treating apparatus T may include the detergent dissolution device 5 to allow the laundry treating apparatus to perform a washing operation using a powdered detergent. In contrast, without such a dissolution device, the detergent storage device 4 would be positioned below the introduction port 11. In this arrangement, if a liquid detergent were used, the pump 53 would supply the detergent and wash water discharged from the detergent box 43 to the tub 15. However, if a powdered detergent were supplied to the detergent box 43, it may be difficult to dissolve the detergent in the wash water for supply to the tub 15.

In contrast, the laundry treating apparatus 100 as embodied and broadly described herein may circulate the wash water and detergent introduced into the dissolution box 51 via the pump 53 and the dissolution flow path 57 for a certain time, and thereby the detergent may dissolve in the wash water before being supplied to the tub. Therefore, even when powdered detergent is stored in the detergent box 43, dissolved detergent may be supplied to the tub to more effectively wash the laundry.

In addition, the powdered detergent dissolved in the wash water (the powdered detergent solution) may be supplied to the tub, and therefore malfunction of the pump 53 or clogging of a tub supply flow path 59 caused by supply of an incompletely dissolved detergent to the tub may be prevented.

To facilitate circulation of the detergent and wash water along the dissolution flow path 57, the dissolution box 51 may be provided with an inclined surface 571.

Referring to FIG. 4B showing the cross section of the dissolution box 51, the second flow path connector 515 is arranged on the upper surface of the dissolution box 51, and the first flow path connector 513 is arranged on the bottom surface or the other side of the dissolution box 51 or the side surface, for example, at a lower portion of the side surface or a portion of the side surface adjacent to the bottom surface, of the dissolution box 51. In this case, the inclined surface 571 may define a surface to connect the second flow path connector 515 to the first flow path connector 513.

The inclined surface 571 may be provided as a curved surface or a planar surface connecting the second flow path connector 515 to the first flow path connector 513.

The dissolution box 51 may be provided with the detergent dissolution device 5 of the first treating apparatus T to prevent wash water in the tub from flowing backward to the detergent box 43.

As shown in FIG. 3B, the detergent box 43 may be provided below the introduction port 11. Accordingly, when wash water is supplied to the tub 15, the water level in the tub 15 is above the detergent box 43. Accordingly, in a case in which the detergent box 43 is directly connected to the lower surface of the tub 15, not via the dissolution box 51, or connected to the lower surface of the tub 15 through the circulation pump 61 (see FIG. 7A) provided in the first drainage flow path 311, the wash water in the tub 15 may flow backward to the detergent box 43.

By connecting the detergent box 43 to the tub 15 through the dissolution box 51 located at a position higher than the maximum water level set for the laundry treating apparatus, the above problem may be addressed. In this case, the detergent in the detergent box 43 and the wash water supplied to the detergent box 43 through the water supply device 2 may be supplied to the dissolution box 51 via a separate pump provided in the detergent discharge flow path 45.

Even in a case in which the dissolution box 51 is arranged at a position lower than the maximum water level of the tub 15 set for the laundry treating apparatus, the above problem may be prevented when the detergent solution discharged from the dissolution box 51 is supplied to the tub 15 through the upper portion of the tub 15.

The dissolution box 51 may also include a water level sensor to sense the water level in the dissolution box 51, to prevent backflow of the detergent and wash water from the dissolution box 51 to the detergent box 43. That is, by allowing the water level sensor to sense a water level in the dissolution box 51 equal to or higher than a predetermined water level, a controller may control opening and closing of the water supply valve 21 based on the water level data supplied from the water level sensor, and the detergent and wash water in the dissolution box 51 may be prevented from flowing backward to the detergent box 43 via the detergent discharge flow path 45.

To prevent the detergent and wash water in the dissolution box 51 from flowing backward to the detergent box 43 via the detergent discharge flow path 45, the detergent discharge flow path 45 may be provided with, for example, a check valve or a valve controlled by a controller to open and close the detergent discharge flow path 45.

The detergent dissolved in the wash water via the pump 53 and the dissolution flow path 57 may be supplied to the tub 15 via the tub supply flow path 59. Herein, the tub supply flow path 59 and the second dissolution flow path 573 may be selectively opened or closed by a flow path switching valve 55.

Figure 5A:
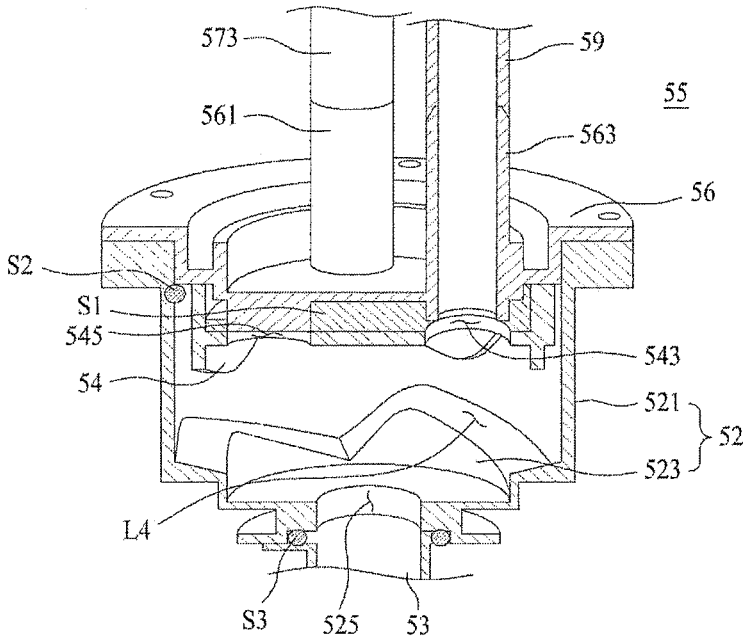
FIGS. 5A-5B and 6A-6B are various views of a flow path switching valve of the laundry treating apparatus shown in FIGS. 1 and 2.
Figure 5B:
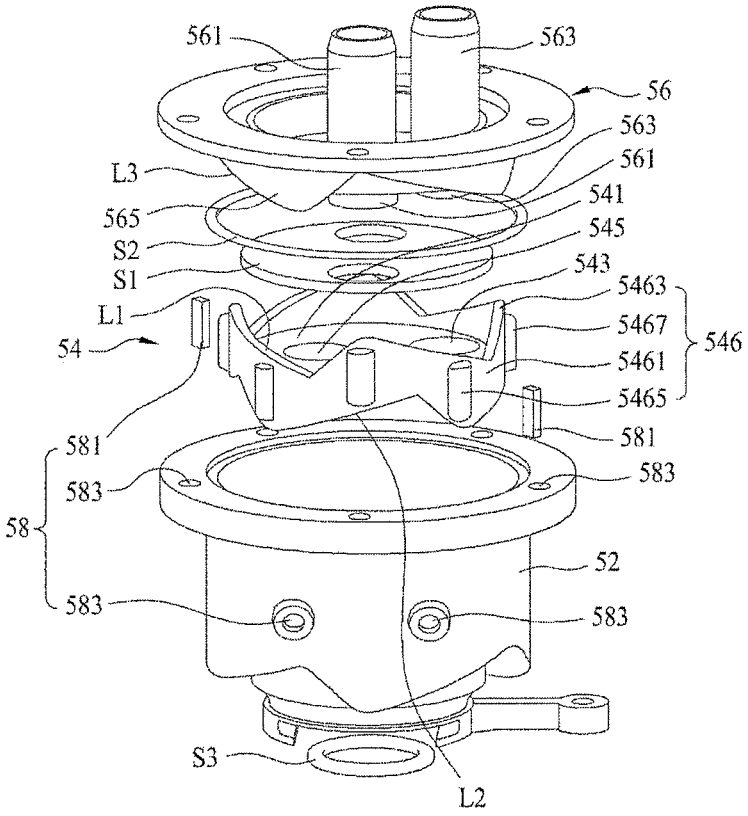

As shown in FIGS. 5A and 5B, the flow path switching valve 55 may include a chamber 52 into which the detergent and wash water discharged from the pump 53 flow, a cover 56 to connect the tub supply flow path 59 and the second dissolution flow path 573 to the chamber 52, a valve 54 capable of rotational and rectilinear reciprocating movement in the chamber 52 to selectively open or close the tub supply flow path 59 and the second dissolution flow path 573.

The chamber 52 may include a cylindrical chamber body 521 having an open top, and a pump communication hole provided in a closed bottom surface of the chamber 52 to allow the detergent and wash water discharged from the pump 53 to flow into the chamber body 521. A lower gear coupling portion 523 may be provided at the bottom surface of the chamber 52, at an outer circumferential surface of the pump communication hole.

The cover 56 may close or seal the open top end of the chamber body 521. The cover 56 may include a dissolution flow path coupling portion 561 and a tub supply flow path coupling portion 563. The second dissolution flow path 573 may be connected to the dissolution flow path coupling portion 561, and the tub supply flow path 59 may be coupled to the tub supply flow path coupling portion 563. The cover 56 may also include an upper gear coupling portion 565 inserted into the chamber body 521 and arranged to surround the dissolution flow path coupling portion 561 and the tub supply flow path coupling portion 563.

The valve 54 may include a body 541 reciprocating between the cover 56 and the pump communication hole according to pressure of the wash water flowing into the chamber 52, a gear 546 to rotate the body 541 during reciprocation of the body 541, and flow path opening holes 543 and 545 provided in the body 541 to supply the detergent and wash water to one of the second dissolution flow path 573 or the tub supply flow path 59 according to a rotational angle of the body 541. The body 541 may be formed in various shapes, such as, for example a disk shape as shown in FIG. 5B. In this case, the flow path opening holes 543 and 545 may penetrate the body 541.

The gear 546 may include a cylindrical gear body 5461 having an open top and bottom, an upper gear 5463 provided at the upper end of the gear body 5461 and coupled to the upper gear coupling portion 565, and a lower gear 5465 provided at the lower end of the gear body 5461 and coupled to the lower gear coupling portion 523. The gear body 5461 may be fixed to the outer circumferential surface of the body 541 to guide reciprocation of the body 541 along the inner circumferential surface of the chamber body 521. The gear body 5461 may include a plurality of protrusions 5467 spaced from each other. When foreign substances are present in the wash water introduced into the chamber 52, the protrusions 5467 may prevent the foreign substances from being stuck between the gear body 5461 and the chamber body 521 to obstruct rotation of the valve 54. The upper gear 5463 may be coupled to the upper gear coupling portion 565 to rotate the valve 54 clockwise, and the lower gear 5465 may be coupled to the lower gear coupling portion 523 to rotate the valve 54 clockwise.

When wash water is not supplied to the chamber 52, the lower gear 5465 may remain coupled to the lower gear coupling portion 523. When wash water is introduced into the chamber 52 by the pump 53, the valve 54 may move toward the cover 56 due to the water pressure, and the upper gear 5463 may be coupled to the upper gear coupling portion 565 of the cover 56 through the movement of the valve 54.

The upper gear 5463 and the upper gear coupling portion 565 may have a tooth shape to mesh or engage with each other. When the upper gear 5463 is coupled to the upper gear coupling portion 565, the valve 54 may rotate clockwise by a certain angle. As the valve 54 rotates, the flow path opening holes 543 and 545 provided in the body 541 may open one of the dissolution flow path coupling portion 561 or the tub supply flow path coupling portion 563. Accordingly, the wash water and detergent may be supplied from the chamber 52 to one of the second dissolution flow path 573 or the tub supply flow path 59.

When the pressure in the chamber 52 decreases (i.e., when the pump 53 stops operating or the rate of rotation of the pump 53 is adjusted to reduce the amount of wash water introduced into the chamber 52), the valve 54 may move toward the pump communication hole. As the valve 54 moves toward the pump communication hole, the lower gear 5465 may be coupled to the lower gear coupling portion 523 provided at the bottom surface of the chamber 52. The lower gear 5465 and the lower gear coupling portion 523 may also be formed in a tooth shape to engage with each other.

Figure 6A:
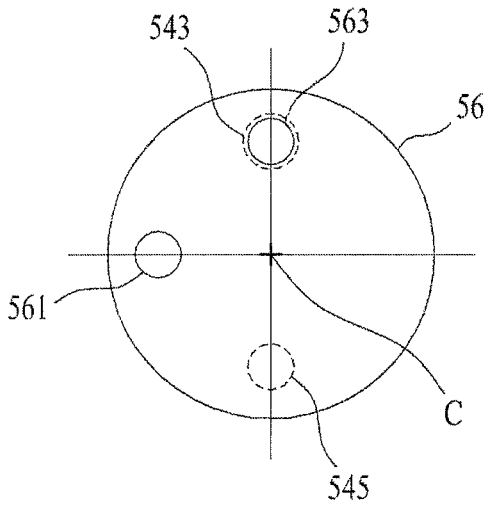
Figure 6B:
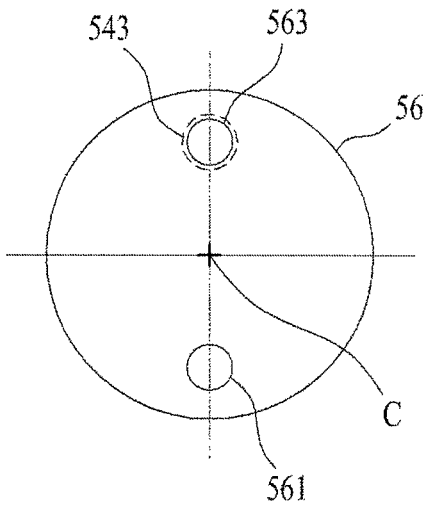

Accordingly, when the lower gear 5465 is coupled to the lower gear coupling portion 523, the valve 54 rotates clockwise (in a direction in which the valve 54 rotates when the upper gear engages with an upper gear engagement portion). A rotational angle of the valve 54 at which the upper gear 5463 is coupled to the upper gear coupling portion 565 and a rotational angle of the valve 54 at which the lower gear 5465 is coupled to the lower gear coupling portion 523 may be set as shown in FIGS. 6A-6B.

In a case in which the dissolution flow path coupling portion 561 is spaced 90 degrees apart from the tub supply flow path coupling portion 563 with respect to the center of rotation C of the body 541 (see FIG. 6A), the valve 54 may rotate 45 degrees clockwise when the upper gear 5463 is coupled to the upper gear coupling portion 565 and may rotate 45 degrees clockwise when the lower gear 5465 is coupled to the lower gear coupling portion 523.

That is, the oblique surface L1 of the upper gear 5463 and the oblique surface L3 of the upper gear coupling portion 565, and the oblique surface L2 of the lower gear 5465 and the oblique surface L4 of the lower gear coupling portion 523 may be arranged to allow the valve 54 to rotate 45 degrees. In this case, the flow path opening hole may include a first hole 543 and a second hole 545 which are spaced 180 degrees apart from each other with respect to the center of rotation C of the body 541. Accordingly, when the pressure in the chamber 52 decreases with the tub supply flow path coupling portion 563 opened by the first hole 543, the lower gear 5465 is coupled to the lower gear coupling portion 523 to rotate the first and second holes 45 degrees clockwise. Thereafter, when the pressure in the chamber 52 increases, the upper gear 5463 is coupled to the upper gear coupling portion 565 to rotate the first hole 543 another 45 degrees clockwise to open the dissolution flow path coupling portion 561.

In a case in which the dissolution flow path coupling portion 561 and the tub supply flow path coupling portion 563 are spaced 180 degrees apart from each other with respect to the center of rotation C of the body 541 (see FIG. 6B), the valve 54 may rotate 90 degrees clockwise when the upper gear 5463 is coupled to the upper gear coupling portion 565 and may rotate 90 degrees clockwise when the lower gear 5465 is coupled to the lower gear coupling portion 523. In this case, the flow path opening hole may include only the first hole 543. Accordingly, when the pressure in the chamber 52 decreases with the tub supply flow path coupling portion 563 opened by the first hole 543, the lower gear 5465 is coupled to the lower gear coupling portion 523 to rotate the first hole 90 degrees clockwise. Thereafter, when the pressure in the chamber 52 increases, the upper gear 5463 is coupled to the upper gear coupling portion 565 to rotate the first hole 543 another 90 degrees clockwise to open the dissolution flow path coupling portion 561.

Accordingly, the flow path switching valve 55 described above may open either the dissolution flow path 57 or the tub supply flow path 59 based on the water pressure in the chamber 52.

In the flow path switching valve 55 described above, the valve 54 is rotated only clockwise by the upper gear 5463, the lower gear 5465, the upper gear coupling portion 565, and the lower gear coupling portion 523. However, the upper gear 5463, the lower gear 5465, the upper gear coupling portion 565, and the lower gear coupling portion 523 may be designed to rotate the valve 54 counterclockwise.

In addition, the flow path switching valve 55 may further include a position sensing device, or sensor, 58 to sense the position of the valve 54, and a sealing member S1, S2, S3 to seal the chamber. The sealing members may include a first seal S1 arranged below of the cover 56 and positioned in the upper gear coupling portion 565, a second seal S2 arranged below the cover 56 on the outer circumferential surface of the upper gear coupling portion 565, and a third seal S3 to seal the pump communication hole. The first seal S1 may include a through hole through which the dissolution flow path coupling portion 561 and the tub supply flow path coupling portion 563 are received.

When the operation of the pump 53 is stopped (i.e., when the operation of the first treating apparatus T is stopped), the lower gear 5465 of the valve 54 provided in the flow path switching valve 55 is coupled to the lower gear coupling portion 523. However, when the operation of the pump 53 resumes, the flow path opening holes 543 and 545 may open one of the dissolution flow path coupling portion 564 or the tub supply flow path coupling portion 563.

When one of the dissolution flow path coupling portion 564 or the tub supply flow path coupling portion 563 opened by the flow path opening holes 543 and 545 is not recognized, undissolved detergent may be supplied to the tub. The position sensing device 58 may address this risk.

The position sensing device 58 may include at least one magnetic force generating device 581 arranged in the valve 54, and at least one magnetic force sensing device 583 arranged in the chamber 52 to sense magnetic force produced by the magnetic force generating device 581. A plurality of magnetic force generating device 581 may be provided in or on the gear body 5461, and a plurality of magnetic force sensing device 583 may be arranged along the outer circumferential surface of the chamber body 521.

Each of the magnetic force generating devices 581 may be, for example, a magnet and may be disposed between adjacent protrusions 5467. This may eliminate the need for additional space to accommodate the magnetic force generating device(s) 581 in the valve 54.

The magnetic force sensing device(s) 583 may be arranged along the outer circumferential surface of the chamber body 521, for example, at the upper and lower portions of the chamber body 521 as shown in FIG. 5B, or only at the lower portion of the chamber body 521.

Accordingly, the controller may identify the positions of the flow path opening holes 543 and 545 based on the positions of the magnetic force generating device(s) 581 detected by the magnetic force sensing device(s) 583. When the position of the valve 54 needs to be changed, the position of the valve 54 may be changed by temporarily turning on and off the pump 53 to open the desired one of the dissolution flow path coupling portion 564 or the tub supply flow path coupling portion 563.

The position sensing device 58 may include the magnetic force generating device(s) 581 arranged in the chamber 52, or the magnetic force sensing device(s) 583 arranged in the valve 54 to sense magnetic force produced by the magnetic force generating device(s) 581.

While the tub supply flow path 59 and the second dissolution flow path 573 are illustrated in this embodiment as being selectively opened by the flow path switching valve 55, the tub supply flow path 59 may be formed as a branch from the second dissolution flow path 573. That is, the tub supply flow path 59 may be arranged such that one end thereof is connected to the second dissolution flow path 573, and the other end thereof is connected to the tub 15. In this case, a switching vale to selectively open the tub supply flow path 59 and the second dissolution flow path 573 may be needed at the branch point at which the tub supply flow path 59 is branched from the second dissolution flow path 573. The switching valve may be of various types. The switching valve may be, for example, a flow path switching valve, or a valve having one inlet port (connected to the pump) and two outlet ports (respectively connected to the dissolution flow path coupling portion and the tub supply flow path coupling portion) opened and closed by the controller.

Figure 7A:
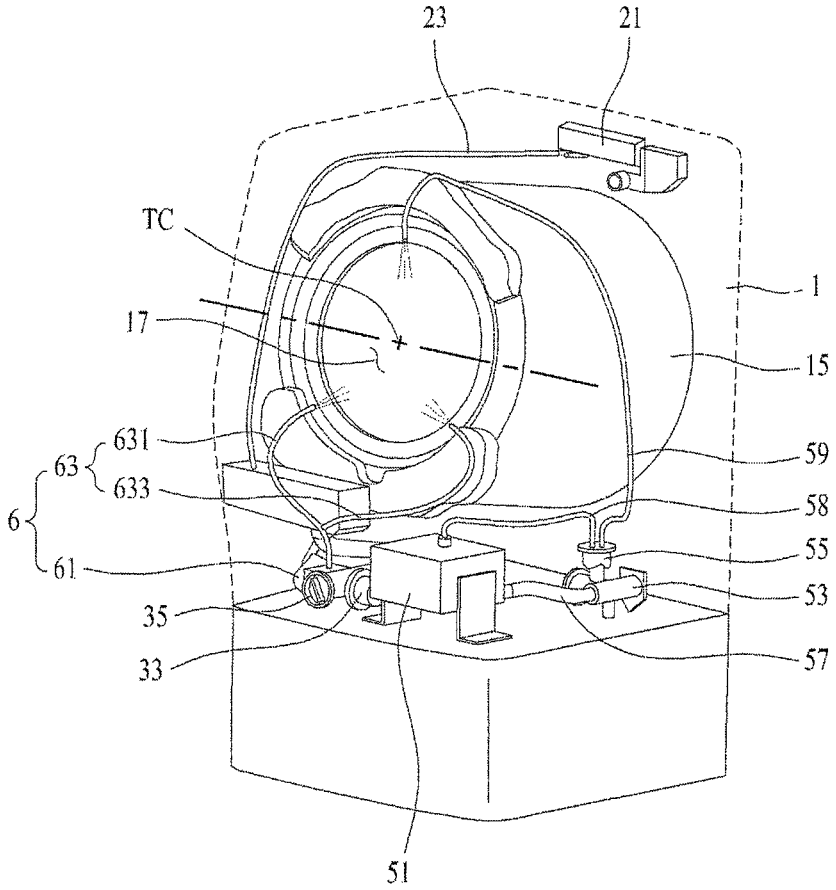
FIGS. 7A and 7B illustrate a laundry treating apparatus having a wash water circulation device, in accordance with embodiments as broadly described herein.
Figure 7B:
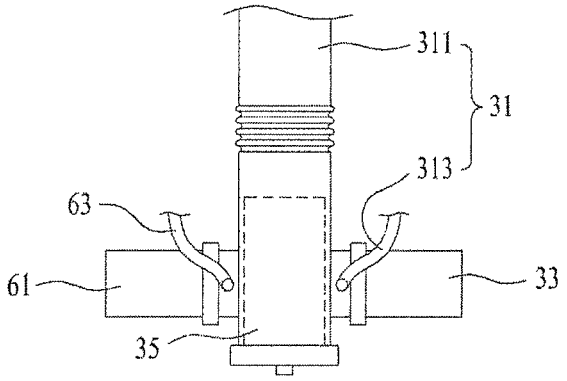

FIGS. 7A and 7B illustrate a laundry treating apparatus including a wash water circulation device, in accordance with embodiments as broadly described herein.

A wash water circulation device 6 may include a circulation pump 61 arranged in the first drainage flow path 311, and a circulation flow path 63 connecting the circulation pump 61 to the tub 15 to supply the wash water pressurized by the circulation pump 61 to the drum 17.

The circulation flow path 63 may include a first circulation flow path 631 and a second circulation flow path 633. The second circulation flow path 633 may be branched from the first circulation flow path 631 connecting the circulation pump 61 to the tub 15. One end of the first circulation flow path 631 coupled to the tub 15 and one end of the second circulation flow path 633 coupled to the tub 15 may be positioned above or below a line passing through the center of a tub opening TC and parallel with the ground (a center line). In this case, one end of the tub supply flow path 59 connecting the flow path switching valve 55 to the tub 15 may be positioned over the center line. Thereby, the first treating apparatus T may inject wash water into the laundry accommodated in the drum in three directions.

In the first treating apparatus T which may execute an operational course including a washing operation and rinsing operation, the tub supply flow path 59 may function as a detergent supply flow path and wash water injection flow path. That is, in the washing operation, once the water supply device 2 supplies a certain amount of wash water to the detergent storage device 4 necessary to dissolve the detergent in the wash water, the controller supplies the detergent solution to the tub through the pump 53.

Then, the controller controls the water supply device 2 and the pump 53 such that the wash water for washing the laundry in the drum 17 is supplied to the tub 15. Once a certain amount of wash water is supplied to the tub 15, the circulation pump 61 may inject the wash water introduced into the first drainage flow path 311 from the tub 15 into the drum 17 through the circulation flow path 63.

When the wash water is injected onto the laundry received in the drum 17 in several directions, the laundry may be effectively washed. Thereby, washing performance of the first treating apparatus T may be improved.

In the rinsing operation, the water supply device 2 supplies a certain amount of wash water, set based on an amount of laundry, to the tub 15 via the detergent storage device 4, the dissolution box 51, the first dissolution flow path 571, the pump 53 and the tub supply flow path 59. In this case (rinsing), the detergent storage device 4 does not contain the detergent.

When the wash water is supplied to the tub 15, the circulation pump 61 may inject the wash water introduced into the first drainage flow path 311 into the drum 17 through the circulation flow path 63, and the pump 53 may inject the wash water supplied from the water supply device 2 into the drum 17. Therefore, the rinsing performance of the first treating apparatus T may be improved.

If the wash water were injected onto the laundry during the rising operation through the water supply flow path 23 connecting the water supply valve 21 and the tub 15, the wash water may not be supplied to the laundry at a sufficient pressure for rinsing.

In contrast, in the first treating apparatus T as embodied and broadly described herein, however, the wash water supplied to the laundry for the washing operation or the rinsing operation is injected by the pump 53, and thus wash water having a constant magnitude of pressure may be continuously supplied to the laundry, thus improving washing performance.

As described above, the laundry treating apparatus as embodied and broadly described herein may further include a second treating apparatus L arranged under the first treating apparatus T. As shown in FIG. 2 the second treating apparatus L may include a housing to support the first treating apparatus T, a drawer 8 slidably received in the housing, and a treatment space 9 provided in the drawer to 8 accommodate the laundry. As shown in FIG. 3, a tub 91 may be provided in the treatment space 9 to contain wash water, and a drum 93 may be rotatably provided in the tub 91 to accommodate the laundry.

In certain embodiments, the drawer 8 may be provided with a driver 95 to rotate the drum 93, a water supply device to supply wash water to the tub 91 and a drainage device to drain the wash water from the tub 91.

If the second treating apparatus L also include a hot air supply device to supply hot air to the treatment space 9, the second treating apparatus L may also perform a drying operation on the laundry.

A laundry treating apparatus as embodied and broadly described herein may include a detergent storage unit or device provided below an introduction port for introduction of laundry. Accordingly, the user may easily introduce detergent into the detergent supply unit.

In addition, a laundry treating apparatus as embodied and broadly described herein a detergent dissolution unit or device to dissolve powdered detergent in wash water to supply the dissolved detergent to the laundry. Accordingly, washing performance may be improved.

In addition, a laundry treating apparatus as embodied and broadly described herein a flow path switching valve. Thereby, a flow path for dissolution of detergent and a flow path for supply of the detergent dissolved in the wash water to a tub may be selectively opened by the flow path switching valve.

A laundry treating apparatus is provided including a detergent storage unit arranged at a lower portion of an introduction port for introduction of laundry.

A laundry treating apparatus is provided including a detergent dissolution unit to dissolve a powdered detergent in wash water to supply the detergent to the laundry.

A laundry treating apparatus is provided including a flow path switching valve to selectively open a flow path for dissolution of a detergent and a flow path for supply of the detergent dissolved in the wash water to a tub.

A laundry treating apparatus as embodied and broadly described herein, may include a cabinet provided with an introduction port for introduction of laundry, a tub arranged in the cabinet to contain wash water and provided with a tub opening communicating with the introduction port, a drum rotatably arranged in the tub and adapted to accommodate the laundry introduced through the tub opening, a detergent storage unit to store a detergent, the detergent storage unit being positioned at a lower portion of the introduction port, a water supply unit to supply water to the detergent storage unit, and a detergent dissolution unit to dissolve the detergent discharged from the detergent storage unit in the water supplied from the water supply unit and then supply the same to the tub.

The detergent dissolution unit may include a dissolution box to store the detergent and water discharged from the detergent storage unit, a dissolution flow path and a pump to discharge the detergent and water in dissolution box to an outside of the dissolution box and then resupply the same to the dissolution box, and a tub supply flow path to supply the detergent dissolved in the water to the tub.

The dissolution box may be arranged at a position higher than a maximum level of the water stored in the tub.

The dissolution box may be arranged at a position lower than a position of the detergent storage unit and lower than a maximum level of the water stored in the tub, and the tub supply flow path may be arranged such that the detergent and water are supplied to the tub from a position higher than a maximum level of the water stored in the tub.

The dissolution flow path may include a first dissolution flow path to guide the detergent and water in the dissolution box to the pump, and a second dissolution flow path to guide the detergent and water discharged from the pump to the dissolution box.

The dissolution box may include a second flow path connector connected to the second dissolution flow path, and a first flow path connector connected to the first dissolution flow path, wherein the second flow path connector may be fixed to an upper surface of the dissolution box, and the first flow path connector may be arranged on a bottom surface or a side surface of the dissolution box.

The dissolution box may further include an inclined surface to connect the second flow path connector to the first flow path connector.

The laundry treating apparatus may further include a water level sensor to sense a water level in the dissolution box.

The detergent storage unit may include a storage unit door rotatably provided to the cabinet and positioned at a lower portion of the introduction port, a detergent box positioned at the storage unit door to store the detergent and to receive water from the water supply unit, and a discharge flow path to supply the detergent and water in the detergent box to the dissolution box.

The detergent box may be detachably provided to the storage unit door.

The tub supply flow path may be branched from the second dissolution flow path and connected to the tub, wherein a switching valve to control opening and closing of the second dissolution flow path and the tub supply flow path may be provided at a branch point, the tub supply flow path being branched from the second dissolution flow path.

The detergent dissolution unit further may include a flow path switching valve to connect the second dissolution flow path and the tub supply flow path to the pump and to selectively open the second dissolution flow path and the tub supply flow path.

The flow path switching valve may include a chamber provided with a pump communication hole allowing the detergent and water discharged from the pump to be introduced into, a cover to connect the second dissolution flow path and the tub supply flow path to the chamber, and a valve including a body to reciprocate between the cover and the pump communication hole according to a pressure in the chamber, a flow path opening hole provided in the body, a gear to rotate the body to allow the flow path opening hole to open one of the second dissolution flow path and the tub supply flow path.

The laundry treating apparatus may further include an upper gear coupling portion provided to the cover, and a lower gear coupling portion provided to the chamber and arranged to surround the pump communication hole, wherein the gear may include a gear body formed in a cylindrical shape having an open top and a open bottom and fixed to an outer circumferential surface of the body, an upper gear arranged at an upper end of the gear body and coupled to the upper gear coupling portion to rotate the gear body by a predetermined angle either clockwise or clockwise, and a lower gear arranged at a lower end of the gear body and coupled to the lower gear coupling portion to rotate the gear body by a predetermined angle in the same direction of rotation of the gear body by coupling between the upper gear and the upper gear coupling portion.

The flow path switching valve may further include a magnetic force generating means provided to one of the valve and the chamber, and a magnetic force sensing means provided to the other one of the valve and the chamber to sense magnetic force produced by the magnetic force generating means to sense a position of the flow path opening hole.

The laundry treating apparatus may further include a drainage flow path allowing the wash water stored in the tub to be discharged thereto, a circulation pump to pressurize the wash water discharged to the drainage flow path, and a circulation flow path to connect the circulation pump to the tub to inject the wash water pressurized by the circulation pump into the drum.

One end of the circulation flow path connected to the tub may be positioned below a center line defined as a line passing through a center of the tub opening and parallel with the ground, and one end of the tub supply flow path connected to the tub may be positioned above the center line.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a cabinet a tub provided in the cabinet;

a drum rotatably provided in the tub and configured to receive laundry therein through an opening in the tub and a corresponding opening in the cabinet;

a detergent storage device provided below the opening in the cabinet;

a water supply device configured to supply water to the detergent storage device; and a detergent dissolution device configured to dissolve detergent discharged from the detergent storage device in water supplied by the water supply device and to then supply a mixed water and detergent titian to the tub, wherein the detergent dissolution device includes:

a dissolution box configured to receive the mixed water and detergent solution discharged from the detergent storage device;

a dissolution flow path and a pump configured to discharge the mixed water and detergent solution from the dissolution box and to then resupply the mixed water and detergent solution back to the dissolution box so as to circulate the mixed water and detergent solution and dissolve the detergent in the water;

a tub supply flow path to supply the mixed water and detergent solution from the dissolution box to the tub; and a switching valve provided at a branch point of the tub supply flow path and the dissolution flow path to selectively open the tub supply flow path and the dissolution flow path.

2. The laundry treating apparatus of claim 1, wherein the dissolution box is positioned below the detergent storage device and below a maximum water level of the tub, and the tub supply flow path is arranged such that the mixed water and detergent solution are supplied to the tub from a position above the maximum water level of the tub.

3. The laundry treating apparatus of claim 1, wherein the dissolution flow path includes:

a first dissolution flow path to guide the mixed water and detergent solution received in the dissolution box from the dissolution box to the pump; and a second dissolution flow path to guide the mixed water and detergent solution discharged from the pump to the dissolution box.

4. The laundry treating apparatus of claim 3, wherein the dissolution box includes:

a first flow bath connector connected to the first dissolution flow path and arranged on a bottom surface or a side surface of the dissolution box; and a second flow path connector connected to the second dissolution flow path and fixed to an upper surface of the dissolution box.

5. The laundry treating apparatus of claim 4, wherein the dissolution box further includes an inclined surface to connect the second flow path connector to the first flow path connector.

6. The laundry treating apparatus of claim 4, further including a water level sensor configured to sense a water level in the dissolution box.

7. The laundry treating apparatus of claim 3, wherein the detergent storage device includes:

a storage door rotatably coupled to the cabinet and positioned below the opening formed in the cabinet;

a detergent box provided on the storage door to receive and store the detergent and to receive water from the water supply device; and a discharge flow path coupled to the detergent box to supply the mixed water and detergent solution from the detergent box to the dissolution box.

8. The laundry treating apparatus of claim 7, wherein the detergent box is detachably coupled to the storage door.

9. The laundry treating apparatus of claim 3, wherein the tub supply flow path is blanched from the second dissolution flow path and is connected to the tub, and wherein the switching valve is provided at the branch point of the tub supply flow path the dissolution flow path to control opening and closing of the second dissolution flow path and the tub supply flow path.

10. The laundry treating apparatus of claim 3, wherein the detergent dissolution device further includes a flow path switching valve to connect the second dissolution flow path and the tub supply flow path to the pump, and to selectively open the second dissolution flow path and the tub supply flow path.

11. The laundry treating apparatus of claim 10, wherein the flow path switching valve includes:

a chamber having a pump communication hole formed therein, wherein the mixed water and detergent solution discharged from the pump is introduced into the chamber through the pump communication hole:

a cover to connect the second dissolution flow path and the tub supply flow path to the chamber; and a valve, including:

a valve body configured to reciprocate between the cover and the pump communication hole in response to a pressure in the chamber;

a flow path opening hole provided in the valve body; and a valve gear configured to rotate the valve body so as to align the flow path opening hole with one of the second dissolution flow path or the tub supply flow path.

12. The laundry treating apparatus of claim 11, further including:

a upper gear coupling portion provided on the cover; and a lower gear coupling portion provided on the chamber, surrounding the pump communication hole, wherein the valve gear includes:

a cylindrical gear body having an open top and an open bottom, the cylindrical gear body being fixed to an outer circumferential surface of the valve;

an upper gear provided at an upper end of the gear body and coupled to the upper gear coupling portion of the cover to rotate the gear body by a predetermined angle in one of a clockwise or counter-clockwise direction; and a lower gear provided at a lower end of the gear body and coupled to the lower gear coupling portion of the cover to rotate the gear body by a predetermined angle in the one of the clockwise or counter-clockwise direction generated by coupling between the upper gear and the upper gear coupling portion.

13. The laundry treating apparatus of claim 12, wherein the flow path switching valve further includes:

a magnetic force generator provided on one of the valve or the chamber; and a magnetic force sensor provided on the other of the valve or the chamber to sense magnetic force generated the magnetic force generator and sense a corresponding position of the flow path opening hole.

14. The laundry treating apparatus of claim 1, further including:

a drainage flow path that guides wash water stored in the tub for discharge from the tub;

a circulation pump that pressurizes the wash water discharged to the drainage flow path; and a circulation flow path that connects the circulation pump to the tub to inject the wash water pressurized by the circulation pump back into the drum.

15. The laundry treating apparatus of claim 14, wherein:

an end of the circulation flow path connected to the tub is positioned below a center line passing through a center of the opening in the tub and parallel with an installation surface of the laundry treating apparatus; and an end of the tub supply flow path connected to the tub is positioned above the center line.

16. The laundry treating apparatus of claim 1, wherein only one valve used to selectively open the tub supply flow path and the dissolution flow path.

17. The laundry treating apparatus of claim 1, wherein additional water is not provided to the dissolution box.

* * * * *